United States Patent [19]

Helton et al.

[11] 4,011,051

[45] Mar. 8, 1977

[54] COMPOSITE WEAR-RESISTANT ALLOY, AND TOOLS FROM SAME

[75] Inventors: Eugene L. Helton, Peoria; Preston L. Gale, Chillicothe; Lowell J. Moen, Peoria, all of Ill.; Robert C. Mueller, Mentor, Ohio; Walker L. Pierce, Jr.; Henry J. Vermillion, Jr., both of Peoria, Ill.

[73] Assignee: Caterpillar Tractor Co., Peoria, Ill.

[22] Filed: May 2, 1974

[21] Appl. No.: 466,142

[52] U.S. Cl. ..... 29/182; 29/182.5; 75/202; 75/212

[51] Int. Cl.[2] ..... B22F 3/00

[58] Field of Search ..... 29/182.5, 182; 75/202, 75/212

[56] References Cited

UNITED STATES PATENTS

| | | | |
|---|---|---|---|
| 1,913,373 | 6/1933 | Golyer | 75/202 |
| 2,802,748 | 8/1957 | Glaser | 75/207 |
| 3,275,426 | 9/1966 | Rowady | 75/202 |
| 3,342,563 | 9/1967 | Butts | 75/212 |
| 3,470,030 | 9/1969 | Lindholm | 75/202 |
| 3,708,283 | 1/1973 | Hill | 29/182 |
| 3,752,655 | 8/1973 | Ramquist | 75/212 |
| 3,900,936 | 8/1975 | Hill | 75/201 |

*Primary Examiner*—Brooks H. Hunt
*Attorney, Agent, or Firm*—Phillips, Moore, Weissenberger, Lempio & Majestic

[57] ABSTRACT

Spheroidal particles of wear-resistant alloy comprising boron, chromium and iron having maximum hardness for a given composition are produced by the rapid cooling of a molten alloy mixture. The resultant solid particles are then incorporated into a composite alloy wherein the solid particles are held together with a matrix of different material from the alloy. Inserts of the composite wear-resistant alloy are useful in producing long wearing tools.

9 Claims, 3 Drawing Figures

COMPOSITE WEAR-RESISTANT ALLOY, AND TOOLS FROM SAME

BACKGROUND OF THE INVENTION

This invention relates to a wear-resistant or abrasive resistant alloy, and method of producing this alloy. The invention particularly relates to such an alloy and composite thereof especially suitable for use with ground-engaging tools.

Ground-engaging tools such as ripper tips, bucket teeth and cutting edges for various types of earth-working machines are all subject to accelerated wear during working of the machines due to continual contact of these parts with rock, sand and earth. It is therefore desirable that these tools be comprised of a highly wear-resistant material, e.g., U.S. Pat. Nos. 1,493,191; 3,275,426 and 3,334,996 and further, that such material be relatively inexpensive to thereby minimize the cost when replacement inevitably becomes necessary; note, for instance, British Pat. No. 1,338,140.

Many wear-resistant alloys have been developed for use in such tools and for other uses demanding an alloy of high abrasive resistance. Many such alloys, however, are composed of materials which are not readily available, or are expensive, or both. One such example is tungsten carbide which has excellent wear-resistant properties, but which is relatively expensive. Additionally, particularly in the case of tool manufacture, it is frequently important that the wear-resistant alloy be substantially unimpaired by heat treatment. For example, a convenient method of joining a metal part composed of a wear-resistant alloy to a steel ground-engaging tool is by brazing; this process, however, usually weakens the steel of the tool, making it necessary to heat-treat the steel to strengthen it. Many alloys are adversely affected by such heat treatment, and either cannot be used under these circumstances, or the steel cannot be treated to harden. Frequently, also, known wear-resistant alloys are unsuitable for use with tools which are subjected to frequent shocks, since, typically, these wear-resistant hard alloys are brittle, and readily break under shock treatment.

It is an object of this invention to provide a highly wear-resistant composite alloy which can be heat-treated under conditions employed in hardening steel without being adversely affected.

It is an additional object of this invention to provide a wear-resistant composite alloy which is especially suitable for use with ground-engaging tools.

It is yet another object of this invention to provide a wear-resistant shock-resistant composite alloy.

BRIEF SUMMARY OF THE INVENTION

According to this invention, a wear-resistant alloy of boron, chromium, and iron is provided and optimum hardness of the alloy is obtained by forming the alloy into substantially spheroidal particles which may then be distributed within a matrix of another alloy material to form a "composite" alloy.

As used herein the terms "composite" or "composite alloy" means an alloy material wherein two or more metallurgically distinct alloys are first prepared physically separate one from the other. The separate alloys are then physically mixed together, generally in the "dry" state, and at ambient temperatures to produce an homogeneous mixture thereof. This alloys mixture is then subjected to heat processing wherein a temperature is achieved sufficiently high to cause at least one of the alloys to experience "melting" or at least incipient melting and to thereby "braze" the mixture into a single physical mass. It should be understood that at least one of the alloy components remains essentially physically unchanged during the brazing step.

The resulting composite alloy, although in a single mass, contains both the original alloys in distinctly segregated portions within the mass, and both alloys continue to exhibit their individual metallurgical properties on an individual basis, although the "composite" alloy, as a whole, exhibits its separate and individual metallurgical and physical properties as well.

DETAILED DESCRIPTION OF THE INVENTION

Figure 1:
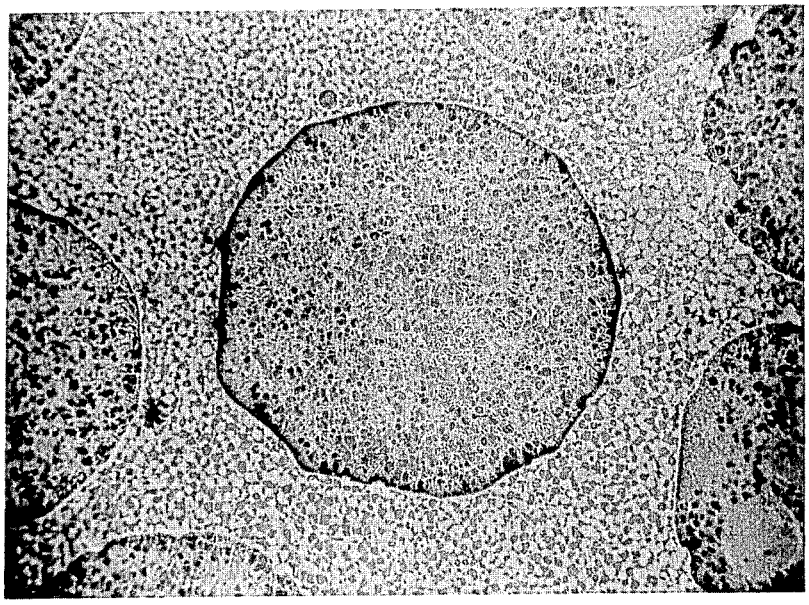
FIG. 1 is a photomicrograph of alloy particles of this invention embedded in an alloy matrix, to form a composite alloy. (magnification — 50X).

The invention comprises a wear-resistant alloy comprised of relatively low cost, readily available elements, that are alloyed and then processed to yield extremely hard wear-resistant particles, especially spheroids. These spheroidal particles are in turn incorporated into a composite alloy that comprises the spheroidal particles in a strong ductile alloy matrix.

The wear-resistant alloy portion of the invention is essentially an iron-chromium based alloy with boron therein.

More particularly, the alloy of the invention substantially comprises boron, chromium and iron in the following amounts in percent by weight:

| | |
|---|---|
| Boron | about 6.0 to about 12% |
| Chromium | about 25 to about 61% |
| Iron | balance |

This combination of elements, in the portions indicated, gives a complex mixture of iron and chromium borides having extremely high hardness values, typically from about 1200 to about 1600 kg/mm$^2$ Knoop (or above about 70 on the Rockwell "C" hardness scale). Although it would normally be expected that the high percentages of boron and chromium defined by the above ranges would result in an extremely brittle alloy composition, this is not really the case with the alloy of the invention. It is likely that this can be attributed to the high percentage of iron in the alloy, which forms an iron phase to give the necessary ductility to the alloy composition.

An alloy, quite similar to the above-noted composition, is also useful as the wear-resistant component in the invention. Specifically boron, chromium, iron and carbon in the ranges:

| | |
|---|---|
| Boron | 6.0 to about 12% |
| Chromium | 61 to about 70% |
| Carbon | 0.05 to about 2% |

-continued

| | |
|---|---|
| Iron | balance |

exhibits extreme hardness when processed into shot as described below.

This can be effectively accomplished by a method comprising pouring the molten alloy mixture onto a surface of material, such as graphite, at ambient temperatures, and which is positioned over a container of liquid coolant. Preferably, the molten mixture is poured into a stream from a suitable height (about 4 to 5 feet) above the cool surface. Conveniently, the liquid coolant may be water, or other suitable liquid. The liquid coolant is arranged to a depth sufficient to assure complete solidification of the alloy particles before they reach the bottom of the quenching liquid.

On striking the cold surface, the molten mixture explodes into thousands of spheroidal particles of various sizes, which immediately fall into the container of coolant where they cool and solidify very rapidly.

High alloy compositions formed by this method exhibit properties of high strength and high hardness, with concomitantly high resistance to wear. The extreme hardness and strength of these alloy particles are thought to be at least in part due to the fine mictrostructure set up in the particles as they are chilled into spheres by rapid cooling.

The relative hardness of the alloy particles produced by the above method has been compared by tests with similarly sized alloy particles of the same chemistry produced by conventional methods. For example, in one test, solid slugs having an alloy composition of 25% Cr, 8.8% B, and 66.2% Fe were broken up and screened to give particles of 10 to 20 mesh, which were found to have a Knoop hardness of about 1100 Kg/mm$^2$ (500 gm. load). Similarly sized particles of the same composition produced by the exploding method described above were found to have Knoop hardness of about 1400 Kg/mm$^2$ (500 gm. load).

In a similar test utilizing an alloy composition of 40% Cr, 10 B and 50 Fe, the particles produced by breaking up a solid casting had a Knoop hardness of 1200 to 1300 Kg/mm$^2$ (500 gm. load), whereas the exploded particles had a Knoop hardness of 1500 to 1600 Kg/mm$^2$ (500 gm. load).

Even harder spheroidal particles have been produced from the alloy compositions including up to 2% carbon in addition to the boron, chromium and iron. One composition of about 62.5% cr, 9% B, 1.8% C and Fe remainder produces a eutectic metallurgical structure of chromium borides and iron carbides. Alloys in this range of composition have yielded shot with a hardness range of 1700–2000 Knoop Kg/mm$^2$ (100 gm. load).

After solidification, the spheroidal alloy particles are removed from the liquid coolant. They are then most advantageously plated with a protective metal, particularly when the particles are to be subsequently brazed with a matrix alloy to form the desired composite. The metal plating serves to protect the alloy from oxidation during storage and further serves to prevent the loss of particle elements to the braze by erosion and diffusion. Diffusion and erosion tend to degrade the desired crystalline structure of the shot particles, at least in the peripheral portions thereof. Suitably, the alloy particles are plated with nickel, although other metals which will provide the desired protection, such as copper or chromium, can be used.

The plating may be a conventional electro-plating method. The spheroidal particles are placed in a container such as a barrel with openings therein covered with fine mesh screens to retain the small particles within the container. The container is then submerged in a metallic plating solution, e.g., Ni and rotated therein while electric current is applied. The plating solution can flow freely through the rotating barrel to reach all the particles therein. A metal coating of about 0.001 to about 0.003 inches is sufficient to retard oxidation and to minimize erosion by the matrix alloy during the sintering or brazing step in production of the composite alloy.

It is frequently advantageous to provide a composite body of alloy particles and matrix material; for example, a composite alloy of spheroidal particles and strong, ductile matrix material yields a composite alloy of great usefulness.

Although the matrix material is chosen according to the properties desired in the finished product, and can be one of a number of commercially available alloys, several matrix materials have been found to be particularly suitable for use when the product is to be used with ground-engaging tools. Two of the exemplary materials have the following composition:

| Elements | I (AMI 930) | (Percent by Weight) | II(AMI 790) |
|---|---|---|---|
| Carbon | 0.07 | | 0.03 |
| Silicon | 7.0 | | 3.50 |
| Copper | 5.0 | | — |
| Manganese | 23.0 | | — |
| Boron | — | | 1.50 |
| Iron | — | | 1.25 |
| Nickel | (Balance) 65.0 | (approx) | 94.0 (approx) |

It should be understood that the above are merely examples of satisfactory matrix alloys. Other alloys are suitable so long as they are tough and ductile and do not strongly erode the wear-resistant alloy particles during brazing or sintering of the composite.

The composite alloy materials comprising the spheroidal alloy particles and matrix material are mixed together in a dry or solid form by any conventional method which insures a uniform mixture. For example, the matrix material, usually in the powdered form and spheroidal alloy particles may be arranged in successive layers and vibrated during mixing. After mixing, the materials are then permanently joined by a conventional brazing or sintering process, for example, in a vacuum furnace.

Figure 2:
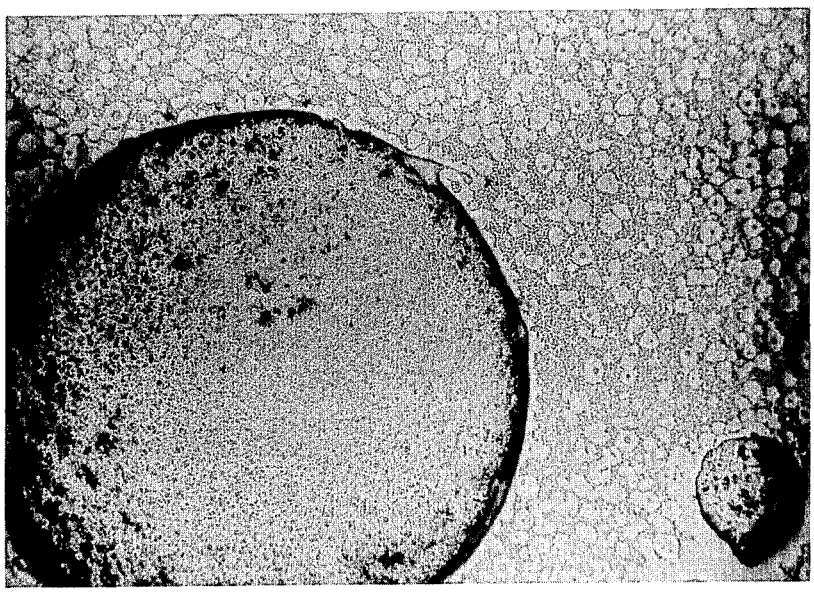
FIG. 2 is another photomicrograph of alloy particles of this invention embedded in an alloy matrix, to form a composite alloy. (magnification — 100X).

FIGS. 1 and 2 of the drawing are photomicrographs of the composite alloy of the invention. They clearly show the spheroidal wear-resistant alloy particles embedded in the matrix material. FIG. 1 shows spheroidal particles that have a composition of 35% Cr, 10.9% B, remainder iron, surrounded by a matrix alloy of 0.03% C, 3.5% Si, 1.5% B, 1.25% Fe and about 94% Ni. The thin nickel plate surrounding the wear-resistant speriod is also apparent. FIG. 2 is also a photomicrograph of a specimen of composite alloy. The spheroidal particle was analyzed at 50% Cr, 10.9% B and the remainder Fe. The matrix was the same alloy as shown in FIG. 1. The spheroidal particle was also nickel plated.

The alloy particles in the composite alloy material should be sufficiently closely spaced to block wear paths when abrasive wear occurs in the composite alloy material. The abrasive wear generally starts as a small groove or slot and proceed through the composite material in the path of least resistance, i.e., through the matrix material since it is the weaker of the two components. However, after the wear path has progressed a short distance, it will encounter a hard alloy particle, and will be stopped or retarded. Thus, sufficient alloy particles should be present in the composite material to stop wear paths before significant damage has occurred through abrasion to the matrix material. Generally, as high a percentage as possible of alloy particles should be incorporated into the matrix material.

It has been found that optimal wear resistance and shock absorption for ground-engaging tool parts is typically obtained when the composite alloy material comprises about 55–70% alloy particles and about 30–45% matrix material, by volume. When the matrix material is either AMI 790 or 930 noted above, about 60% hard alloy to about 40% matrix, by volume, appears to yield the composite alloy with optimum properties. Preferably, the alloy particles selected for incorporation into the matrix material have a size of about 10 to about 40 mesh.

The composite alloy may be formed, most suitably, by mixing the hard alloy spheroids with the matrix alloy in a ceramic or graphite mold in the desired shape. After brazing in a vacuum furnace, the block of composite alloy is cooled to room temperature to yield the desired product. In the composite alloy block, the hard speroidal alloy particles are permanently bound by the matrix alloy to form the composite.

The composite alloy may be joined to a substrate, e.g., tool surface by any appropriate method. If the substrate is a conventional steel ground-engaging tool, the composite material may be appropriately joined to this substrate by brazing. This will ordinarily weaken the steel of the substrate but the steel can then be subjected to a conventional heat-treatment to harden without adversely affecting the composite alloy material.

Figure 3:
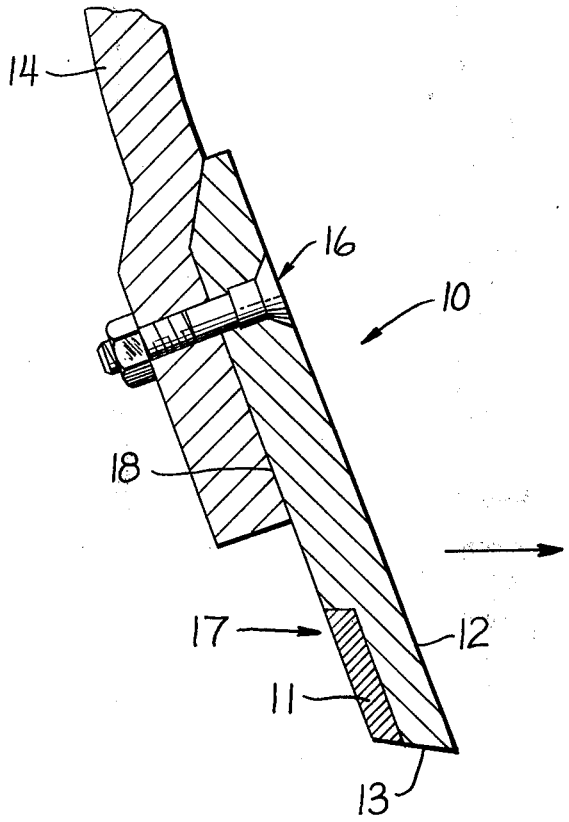
FIG. 3 is a schematic cross-sectional view of a ground-engaging tool tip wherein the composite alloy is incorporated to prolong tool life.

FIG. 3 of the drawing illustrates a typical application of the wear-resistant composite alloy to a tool tip or edge. More specifically, a ground-engaging tool 10 is shown having wear-resistant insert 11 situated posteriorly of front surface 12 of tool 10. An arrow indicates the normal direction of blade movement. Although a blade of elongate configuration, such as a cutting edge of a motor grader blade is illustrated as ground-engaging tool 10, it is to be understood that this embodiment, including the posterior location of insert 11, is similarly applicable to other ground-engaging tools such as ripper tips, bucket teeth and the like. Obviously, wear-resistant insert 11 should be relatively situated with respect to the bottom surface of the specific ground-engaging tool in the same manner as insert 11 is situated with respect to bottom surface 13 and front surface 12 of cutting edge 10.

The cutting edge 10 of FIG. 3 is shown attached to a portion of a motorgrader cutting edge support or mold board 14. The cutting edge 10 is removably secured to board 14 by, for example, a plurality of plow bolt and nut assemblies 16. The distal portion 17 of cutting edge 10 is of substantially lesser thickness than the proximal portion 18 of cutting edge 10. Wear resistant insert 11 is secured as by brazing, or the like, to distal portion 17, thereby providing a substantially uniform cross-sectional area over most of cutting edge 10.

The thinner distal portion 17 of cutting edge 10 may conveniently be formed by machining an original cutting edge 10 of substantially uniform thickness to the desired shape. Variations of the shape of distal portion 17 illustrated in FIG. 3 may be alternatively employed if desired. Insert 11 may be secured to distal portion 17 of cutting edge 10 by brazing or other convenient method. If the material of insert 11 is amenable, it is desirable to reheat steel ground-engaging tools after brazing to restore the metallurgical properties of the tools.

The composite alloy material of this invention exhibits a substantially higher wear resistance than do ordinary production steel; for example, a ripper tip wear test specimen of alloy particles in AMI 930 matrix material showed increases in wear life of 400% to 650% over the wear life of a 4340 steel standard specimen having a hardness of Rockwell "C" 45–50.

In another test, cast blocks of the composite alloy material (AMI 930 matrix) secured in the cutting edge of a ground-engaging tool showed an increase in wear life of 700% to 2000% (depending on test severity) as compared to a standard steel cutting edge. The long wear life of the alloys of this invention and the relatively low cost of the raw materials gives a desirably low "cost/wear life" ratio for these alloys.

The following Example is provided as an illustration of the method and composition of this invention.

EXAMPLE

Hard particles were made from a mixture of Armco Ingot Iron, electrolytic chromium and ferro-boron melted in an induction furnace to as high as 3700° F. The resultant composition of the wear resisting alloy was iron 66%, chromium 25%, and boron 9%. The molten alloy was dropped about 3 feet onto a slanted graphite plate located just above a water filled tank. As the molten alloy stream struck the graphite plate, it was broken into various size particles. When it entered the water, the alloy solidified forming spheroidal particles. By screening, the spheres between 10 and 30 mesh were selected from the hard particles (the size of hard particles in the matrix for optimum wear resistance was found to be approximately in a range of 6 to 40 mesh). The process above resulted in cast spheroidal particles comprised principally of borides with a Knoop Hardness Number of 1400 and above. These particles were then electrolytically cleaned and then coated with a nickel plate to retard surface oxidation and to prevent particle erosion in the braze. The spheroidal particles were then mixed with matrix alloy. The matrix alloy (AMI 930) had the following chemical composition — carbon 0.07%, silicon 7%, copper 5%, manganese 23%, and nickel 65%. The hard particles and the matrix powder were thoroughly mixed and then tamped into the cavity of a graphite mold. In the next step the mixture was then sintered in a vacuum furnace at 1650°–1800° F. The resultant heterogenous composite insert was by volume 55–70% iron-chromium borides and 45–30% matrix. Finally, the composite alloy insert was brazed into a ground-engaging tool surface. For this purpose the insert was attached to the tool with AMI 930 alloy and brazing was accomplished at 1650°–1800° F.

Upon testing, composite alloy ripper tips gave a 400% to 650% increase in wear life when compared to a 4340 steel standard tip (Rc 45–50).

What is claimed is:

1. A composite alloy having high wear-resistance, consisting essentially of cast spheroids of a first alloy consisting essentially of a chromium-iron based alloy of from about 25–70% by weight chromium, from about 6–12% by weight boron, from 0 to about 2% by weight carbon, and iron is the balance, embedded in a matrix of a second tough, ductile alloy in which said first alloy is soluble with difficulty.

2. The composite alloy of claim 1, wherein said spheroids of said first alloy are in the size range of from about 10 to about 40 mesh.

3. The composite alloy of claim 1, wherein the chromium-iron alloy comprises from about 6 to about 12% by weight boron, from about 61 to about 70% by weight chromium, from about 0.05 to about 2% by weight carbon, and iron is the balance.

4. The composite alloy of claim 1, wherein a layer of an erosion retardant metal is interposed between the first alloy particles and the matrix alloy.

5. The composite alloy of claim 4, wherein said erosion retardant layer is nickel.

6. The composite alloy of claim 4, wherein said erosion retardant layer is chromium.

7. The composite alloy of claim 1, wherein the matrix alloy is a brazing alloy.

8. The composite alloy of claim 7, wherein the matrix alloy is principally nickel.

9. The composite alloy of claim 1, wherein the first alloy comprises from about 55 to about 70% by volume and the matrix alloy comprises from about 30 to about 45% by volume.

* * * * *